US005265803A

United States Patent [19]

Thayer

[11] Patent Number: 5,265,803

[45] Date of Patent: Nov. 30, 1993

[54] APPARATUS AND METHOD FOR CONVERTING A POP-UP IRRIGATION SYSTEM TO LOW VOLUME USAGE

[76] Inventor: Susan S. Thayer, 3808 Gaines Cove Dr., Winter Haven, Fla. 33884

[21] Appl. No.: 881,715

[22] Filed: May 12, 1992

[51] Int. Cl.[5] ..... B05B 1/30; B05B 15/10

[52] U.S. Cl. ..... 239/71; 239/201; 239/205; 239/207; 239/DIG. 17; 239/DIG. 23

[58] Field of Search ..... 239/11, 110, 200, 201, 239/203, 204, 205, 207, DIG. 17, DIG. 23, 71

[56] References Cited

U.S. PATENT DOCUMENTS

| | | | |
|---|---|---|---|
| 2,360,203 | 10/1944 | Cox | 239/204 |
| 2,845,302 | 7/1958 | Hanf | 239/204 X |
| 3,613,995 | 10/1971 | Kane | 239/200 |
| 3,806,031 | 4/1974 | Olson | 239/207 |
| 4,078,726 | 3/1978 | Walto | 239/205 |
| 4,479,611 | 10/1984 | Galvis | 239/205 |
| 4,570,858 | 2/1986 | Bintner | 239/71 X |
| 4,735,361 | 4/1988 | Wallace | 239/110 |
| 4,790,481 | 12/1988 | Ray et al. | 239/204 |
| 4,830,057 | 5/1989 | Hendrickson | 239/11 X |
| 4,913,352 | 4/1990 | Witty et al. | 239/205 X |
| 5,004,157 | 4/1991 | Martell | 239/205 |

*Primary Examiner*—Andres Kashnikow
*Assistant Examiner*—William Grant
*Attorney, Agent, or Firm*—Allen, Dyer, Doppelt, Franjola & Milbrath

[57] ABSTRACT

A low volume irrigation sub-assembly is dimensioned to be removably fitted in an extensible riser of a conventional pop-up spray housing. The sub-assembly has an upstanding low volume emitter extending generally axial to the direction of elongation of the housing and the riser, and includes a filter and flow control device for restricting the pressure of water passing between the interior of the riser and the emitter aperture.

18 Claims, 2 Drawing Sheets

APPARATUS AND METHOD FOR CONVERTING A POP-UP IRRIGATION SYSTEM TO LOW VOLUME USAGE

BACKGROUND OF THE INVENTION

The present invention relates generally to irrigation systems.

There has been used in the past so called "pop-up" irrigation units having a housing with an internal riser operated by water pressure within the housing to extend the riser upwardly, and thereafter operate a conventional irrigation sprayer. One such "pop-up" unit is manufactured by the Toro Company under U.S. Pat. Nos. 4,609,146 and 4,682,732. A similar "pop-up" system is sold by the Rainbird Company under U.S. Pat. Nos. 4,316,579 and 4,479,611.

In recent years, there has been increased interest in devising techniques for reducing the volume of water emitted from a conventional sprayer. To that end, they have been devised so called "low volume" emitter systems. One type of emitter system is sold by Thayer Industries, Inc. of Dundee, Florida under the trademark MAXIJET; these products generally consist of a base having a threaded downward extension and a bead across the top of the base, with a "snap on" emitter head having a fixed aperture.

In the past, the pop-up irrigation systems of the type described above have operated at internal pressures on the order of 40–60 pounds per square inch (p.s.i.). However, those pressure levels are not suitable for use with low volume irrigation systems of the MAXIJET-emitter variety tend to pop away from the base at pressures in excess of 25 p.s.i. Further, such low volume emitters tend to clog easily when operated at elevated pressures.

SUMMARY OF THE INVENTION

The present invention has as its purpose the mating of low volume emitter technology with conventional "pop-up" irrigation housings. To this end, there is provided an irrigation sub-assembly specifically dimensioned to be removably fitted in an extensible riser of a conventional pop-up spray housing. The low volume irrigation sub-assembly has an upstanding low volume emitter extending generally axial to the direction of elongation of the housing and the riser, and also includes means for filtering and controlling the flow rate and restricting the pressure of water passing between the interior of the riser and the emitter aperture.

In a specific form, the sub-assembly comprises a platform having upper and lower surfaces and is dimensioned to extend across and be removably connected with the upper extremity of the riser, and further includes an elongated tube coupled with the lower surface so as to extend into the interior of the riser. The flow rate and pressure regulating means and the filtering means are coupled with the tube in the interior of the riser.

In one specific arrangement, the platform includes a protective cup extending upwardly from the upper surface, and generally surrounding and spaced from the emitter.

The means for restricting the flow rate and pressure of water from the riser to the emitter is specifically selected to reduce the pressure of water to the emitter to about 25 p.s.i. or less, thereby avoiding the difficulties for conventional pop-up units which are operable at a pressure on the order of about 50–60 p.s.i. to extend the elongated riser out of the housing.

Suitably, the pressure and flow control rate means has a preselected characteristic, and the outside of the irrigation sub-assembly is coded with a color or other visual indication to thereby denote the particular rating of the flow control and pressure regulation means.

The apparatus and method of the present invention thus provide a low cost technique for converting conventional high volume irrigation "pop-up" spray units to a low volume system in a unique and facile manner. While the above brief summary sets forth some of the important features of the apparatus and method, the ensuing description and the appended claims together with the accompanying drawings reveal additional important features of the apparatus and method.

THE DRAWINGS

DETAILED DESCRIPTION

Figure 1:
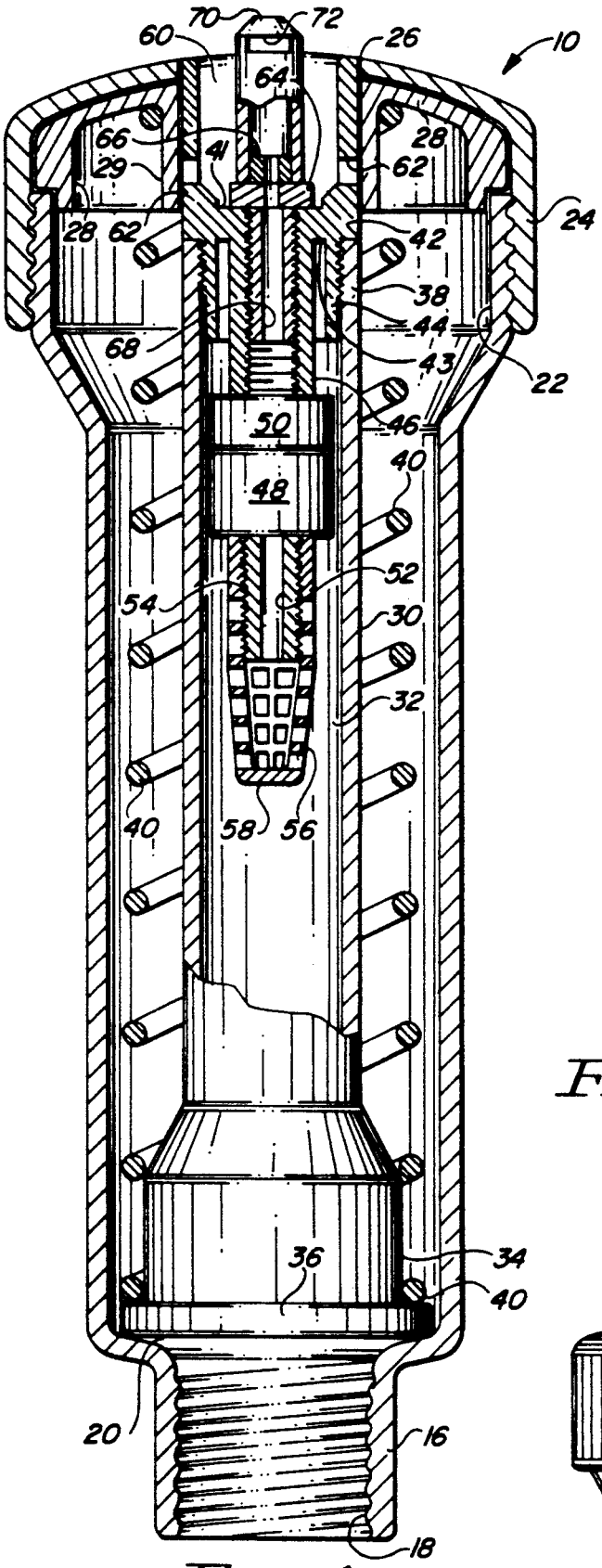
FIG. 1 is an elevation, partially in cross section and with a portion cut away, of a conventional "pop-up" irrigation unit with an installed low volume irrigation sub assembly in accordance with the present invention.

The following is a detailed description of the apparatus and method of the present invention using reference numerals which correspond to like reference numerals in the drawings. This description presumes that the reader has a basis knowledge of the terminology used in the field of irrigation, to which this invention is directed.

Noting FIG. 1, a pop-up irrigation unit is shown and referred to by the reference numeral 10. The pop-up unit 10 includes an elongated housing 12 having a hollow internal cavity 14 and a lower inlet end 16 having internal threads 18 permitting the unit 10 to be coupled to a source of water under pressure. As noted above, the water is typically under a pressure on the order of 40–60 p.s.i., in order to eject the riser 30 out of the housing 12, as described further below.

The housing 12 further includes an upper end 22 having outer threads for engaging a top 24 which forms a part of the housing. The top 24 has a central opening 26 dimensioned to receive the extremity of the riser 32 when extended out of the cavity 14.

The unit 10 also includes a gasket 28 defining a flange 29 which extends concentrically with the opening 26 in the top 24 and which is also dimensioned to concentrically receive the riser 30.

The riser 30 has a hollow internal cavity 32 and extends from the lower surface 34 to the upper surface 38. The lower surface 34 has a flange 36 which rests against a shoulder 20 of the housing 12. A coil spring 40 extends from inside the gasket flange 28 to the lower flange 36, and biases the riser 30 downward against the shoulder 20, until such time as the internal water pressure is sufficient to overcome the tension of the spring 40 and thereby lift the riser 30 upwardly through the opening 26. It will be appreciated by those skilled in the art that the pop-up unit 10 as described thus far is like the aforementioned unit manufactured by the Toro Company.

In accordance with the present invention, the unit 10 is provided with a low volume irrigation sub-assembly including a platform 42 having an upper surface 41 and a lower surface 43. The platform 42 further includes a flange 44 extending downwardly and having threads engaging internal threads at the upper extremity 38 of the riser 30. The platform 42 also includes a downwardly extending tube 46 which extends generally axially into the riser 30. At the extremity of the tube 46 there is fixed a flow control and pressure regulator 48 having a top color cap 50. The flow control and pressure regulator 48 and its associated top cap 50 are conventionally manufactured, for example a product manufactured under the trademark ACU-FLO by the Wade Rain Company of Fresno, California is suitable for affixation to the extremity of the tube 46 in accordance with the present invention. Typically, the ACU-FLO pressure and flow rate regulator 48, 50 has a color code indicating the particular flow rate/pressure at which the regulator 48 operates. Also, the ACU-FLO pressure/flow rate regulator 48 includes an elongated tube 52 within a threaded extension 54 from one end. A filter tube 56 is fixed to the extension 54, the filter 56 having lateral openings and a closed end 58, the filter 56 providing filtration to water passing into the bottom of the pressure/flow rate regulator 48, and thence upwardly through the tube 46.

The low volume irrigation sub-assembly further includes a low volume emitter-base combination, including base 64 and threaded elongated extension 68 engaging corresponding threads at the upper end of the tube 46. A low volume emitter cap 70 is snapped across a bead 66 on the upper surface of the base 64, the emitter cap 70 having a permanent aperture 72 which communicates through the bead 66, base 64, extension 66, tube 46, pressure/flow control regulator 46, and filter 56 to the internal cavity 32 of riser 30.

The low volume sub-assembly further includes a protective cap 60 extending upwardly from the upper surface 41 of the platform 42 to a level just below the emitter opening 72. The protective cap 60 includes drainage opening 62. The cap 60 protects the emitter 70 from damage caused by a string-type cutters and the like used adjacent such pop-up units.

In accordance with the present invention, it is preferred that an external portion of the low volume irrigation sub-assembly be color coded so as to match the color code of top cap 50 for pressure/flow rate regulator 48; such color coding can be done as to the protective cap 60, base 64, emitter cap 70 or any combination of those structural elements.

In accordance with the discussion above, it will be understood that the pressure/flow rate regulator 48 is selected to restrict the pressure of water in the emitter cap 70 to be at a pressure which is substantially less than the normal separation (or "pop-off") pressure of the emitter cap, which is typically on the order of 25 p.s.i. or less. Again, the particular pressure may be dictated by the specific application to which the unit 10 is to be applied, and may range from a low of 6 p.s.i. upwards to 20 p.s.i. or more.

Figure 2:
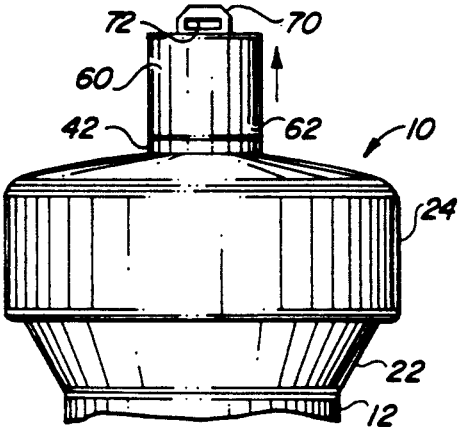
FIG. 2 is front elevation like FIG. 1, partially broken away, illustrating the manner of operation of the low volume irrigation system.

In FIG. 2, the unit 10 is shown with the riser 30 in the extended position, so that platform 42 of the low volume assembly is partially extended through the opening 26, to thereby permit water emitting from the cap 70 to provide the desired irrigation.

Figure 3:
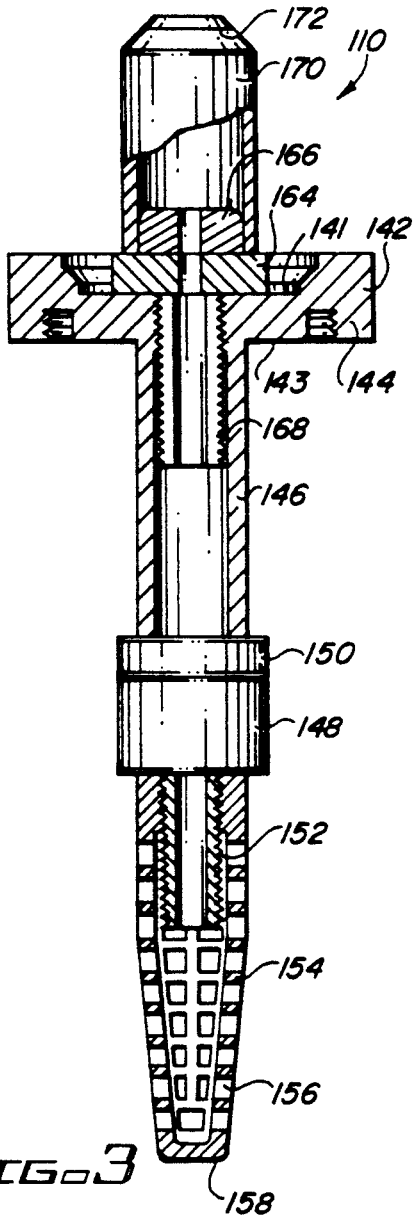
FIG. 3 is an alternate form of an irrigation subassembly like that illustrated in FIG. 1.

FIG. 3 illustrates a second form of a low volume irrigation sub-assembly in accordance with the present invention, which is referred to generally by the reference numeral 110. The sub-assembly 110 is essentially identical to the sub-assembly of FIG. 1, except that the sub assembly 110 does not include the protective cup 60, and is particularly adapted for use with a RAIN BIRD-style pop-up irrigation unit of the type described above.

Referring now to FIG. 3, the sub-assembly 110 includes a platform 142 having a flange 144 which is threaded to engage external threads of a riser tube 9 (not shown). The lower surface 143 of the platform 142 includes an elongated tube 146 adapted for interconnection with an ACU-FLOW pressure/flow control regulator 148 having a color coded top cap 150. A regulator 148 includes an extending tube 152 within a threaded extension 154, about which there is attached a filter 156 having an enclosed end 158. As described above with reference to FIG. 1, the low volume emitter includes a base 164, bead 166, pop-on emitter cap 170, and a fixed opening 172.

Figure 4:
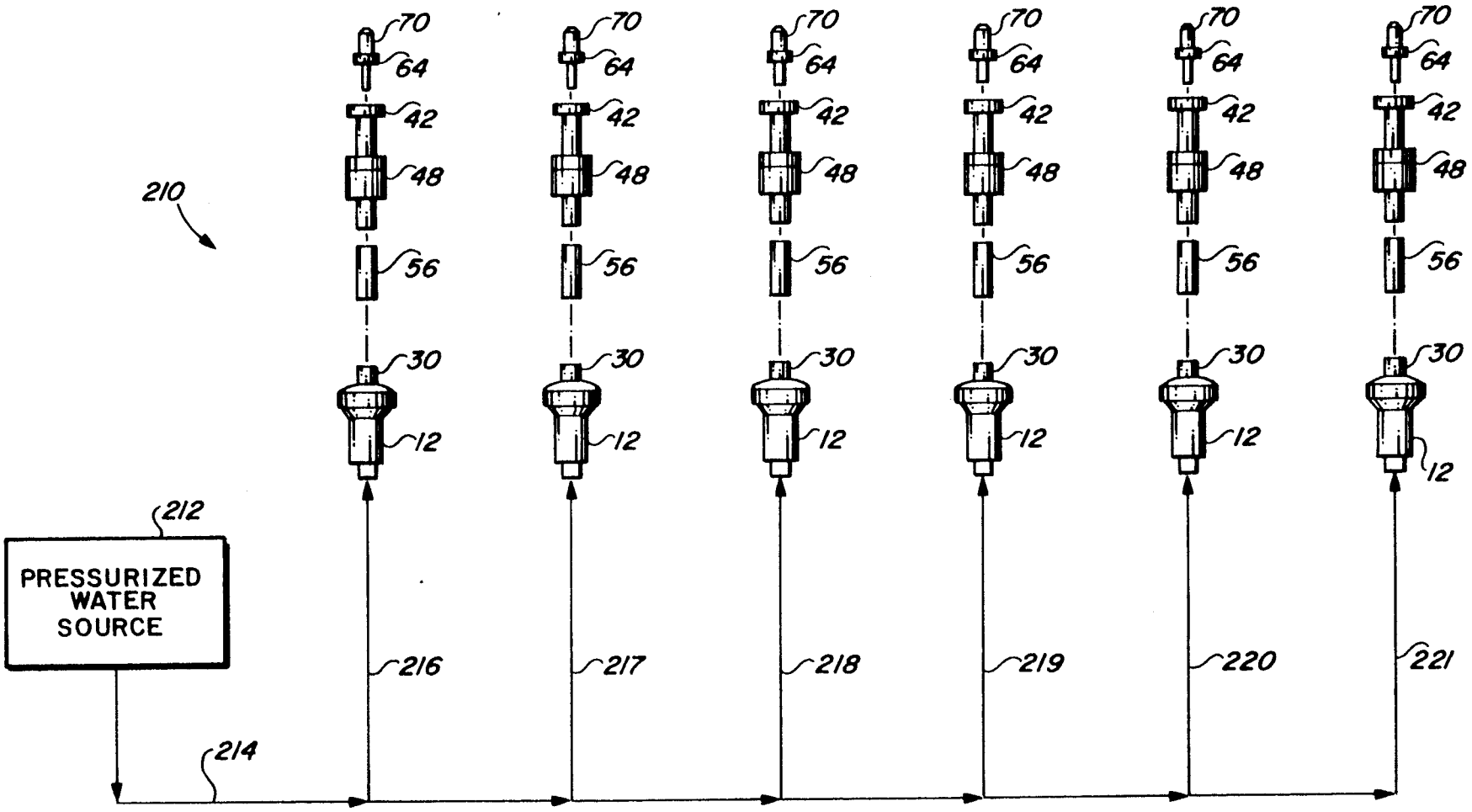
FIG. 4 is a schematic illustration of the manner in which the apparatus and method of the present invention is used for converting to a low volume system an existing high volume pop-up irrigation system in accordance with the present invention.

FIG. 4 illustrates the manner in which the apparatus and method of the present invention is utilized for converting to a low volume system an existing high volume pop-up irrigation system having multiple pop-up units located along a water distribution line, where each pop-up unit has an elongated riser operable at a pressure rating substantially above the rating suitable for low volume emitters.

In FIG. 4, the system is referred to generally by the reference numeral 210 and is adapted for use with a pressurized water source 212 feeding a common distribution line 214 to individual unit lines 216–221.

As was described earlier, a typical "pop-up" irrigation unit 12 has a riser 30 which operates for extension out of the unit 12 only under an internal pressure of between 40–60 p.s.i. In order to adapt a low volume irrigation assembly to such a system so that the riser 30 will continue to operate in the intended manner while the low volume assembly has a restricted pressure and flow rate, each unit 12 is provided with a sub-assembly consisting of the platform 42 and the associated flow rate/pressure regulator 48, to which is attached the filter 56. Thereafter, the low volume emitter base 64 and emitter cap 70 are extended into the platform 42.

It will thus be understood that the present invention provides apparatus and an associated method for converting a high pressure irrigation system to a low volume application, without major expense in refitting the entire irrigation system.

This concludes the description of the preferred embodiments. A reading by those skilled in the art will bring to mind various changes without departing from the spirit and scope of the invention. It is intended, however, that the invention only be limited by the following appended claims.

What is claimed is:

1. A low volume pop-up irrigation assembly, comprising:

an elongated hollow housing having a first open end adapted for connection to a water supply and a second end;

an elongated pop-up riser having a hollow interior and extending through the housing, the riser having a first, open end communicating with the first end of the housing and a second end dimensioned to extend through the second end of the housing;

means for biasing the first end of the riser toward the first end of the housing, the biasing means selected to be overcome by a water pressure within the housing so that the water pressure pushes the second end of the riser out of the second end of the housing;

a low volume irrigation sub-assembly removably fitted in the second end of the riser, the low volume sub-assembly having a platform with upper and lower surfaces and dimensioned to extend across and removably connect with the second end of the riser, an elongated tube coupled with the lower surface of the platform and extending into the interior of the riser, and an upstanding low volume emitter extending generally axial to the direction of elongation of the housing and riser from the upper surface of the platform, the emitter having a fixed spray aperture communicating with the hollow interior of the riser, and the sub-assembly further including means for filtering water passing between the interior of the riser and the emitter aperture;

means for regulating the flow rate of water between the interior of the riser and the emitter aperture; and wherein the flow rate regulating means and the filtering means are coupled with the tube in the interior of the riser, wherein changing the flow rate between the interior of the riser and the emitter aperture requires removal of the sub-assembly from the riser.

2. The irrigation assembly recited in claim 1 wherein the flow rate regulating means is fitted at the extremity of the tube.

3. The irrigation assembly recited in claim 2 wherein the flow rate means includes a hollow extension extending longitudinally through the interior of the riser, and wherein the filtering means is coupled to the extension.

4. The irrigation assembly recited in claim 3 wherein the filtering means comprises an elongated filter element attached with the extension and extending longitudinally through the interior of the riser.

5. The irrigation assembly recited in claim 4 wherein the elongated filter element includes an elongated side wall having filter openings therein, and a closed end.

6. The irrigation assembly recited in claim 1 wherein the second end of the housing has an opening through which the riser extends when under pressure, the platform dimensioned to pass into and out of the opening of the second end of the housing.

7. The irrigation assembly recited in claim 1 wherein the platform includes a protective cup extending upwardly from the upper surface, the cup generally surrounding and spaced from the emitter.

8. The irrigation assembly recited in claim 7 further comprising drain openings through the cup adjacent the platform upper surface.

9. The irrigation assembly recited in claim 1 wherein the sub-assembly further comprises:

a threaded central opening extending into the platform from the upper surface;

the low volume emitter including a threaded elongated base extending into and removably coupled with the threaded central opening of the platform; and the upstanding emitter removably fitted to the base.

10. A low volume pop-up irrigation assembly comprising:

an elongated hollow housing having a first open end adapted for connection to a water supply and a second end;

an elongated pop-up riser having a hollow interior and extending through the housing, the riser having a first, open end communicating with the first end of the housing and a second end dimensioned to extend through the second end of the housing;

means for biasing the first end of the riser toward the first end of the housing, the biasing means selected to be overcome by a water pressure within the housing so that the water pressure pushes the second end of the riser out of the second end of the housing;

a low volume irrigation sub-assembly removably fitted in the second end of the riser, the low volume sub-assembly having a platform with upper and lower surfaces and dimensioned to extend across and removably connect with the second end of the riser, an elongated tube coupled with the lower surface of the platform and extending into the interior of the riser, and an upstanding low volume emitter extending generally axial to the direction of elongation of the housing and riser from the upper surface of the platform, the emitter having a fixed spray aperture communicating with the hollow interior of the riser, and the sub-assembly further including means for filtering water passing between the interior of the riser and the emitter aperture;

means within the riser for regulating the flow rate of water between the interior of the riser and the emitter aperture, wherein changing the flow rate between the interior of the riser and the emitter aperture requires removal of the sub-assembly from the riser; and exterior visual coding means for indicating the flow rate for the sub-assembly.

11. A pop-up irrigation assembly comprising:

a housing having an internal cavity, an inlet opening communicating with the internal cavity, means for connecting the inlet opening to a source of water and a riser opening dimensioned to permit a riser to extend into and out of the housing;

a riser having an upper extremity and located within the cavity, the riser being movable under internal water pressure in the cavity to extend the riser extremity out of the housing;

an emitter sub-assembly removably fitted into the riser extremity and having an emitter including an emitter aperture, the sub-assembly including means for filtering and controlling the flow rate of water passing from the housing inlet into the sub-assembly, including a flow control and pressure regulator connected to a filter; and wherein the means for filtering and controlling flow rate extends axially through the riser such that changing the flow rate between the interior of the riser and the emitter aperture requires removal of the sub-assembly from the riser extremity.

12. The irrigation assembly recited in claim 11 wherein the housing, the riser and the emitter sub-assembly extend generally along a common axial direction.

13. Apparatus for converting into a low volume irrigation system an existing high volume pop-up irrigation system having multiple pop-up units located along a water distribution line with each unit having an elongated riser operable at a pressure on the order of about 40 to 60 p.s.i. and a high volume sub-assembly removably fitted in the extremity of each riser, the apparatus comprising:

plural low volume sub-assemblies each fitted with a snap on low volume emitter having a separation pressure on the order of 25 p.s.i. or less;

each low volume sub-assembly including means for filtering and restricting the pressure of water passing through the corresponding unit to the emitter to a pressure less than said separation pressure; and means for removably installing one of the low volume sub-assemblies in each unit; wherein changing the flow rate between each unit and its corresponding emitter requires removal of the sub-assembly from the corresponding unit.

14. The apparatus recited in claim 13 wherein each means for filtering and restricting the pressure of water is dimensioned to extend axially into the corresponding riser.

15. The apparatus recited in claim 14 further comprising means for coding an external portion of each sub-assembly with an indication of a flow rate for the sub-assembly.

16. A method for converting to a low volume system an existing high volume pop-up irrigation system having multiple pop-up units located along a water distribution line with each unit having an elongated riser operable at a pressure substantially above about 25 p.s.i. and a high volume sub-assembly removably fitted in the extremity of each riser, the method comprising the steps of:

removing the high volume sub-assemblies;

providing plural low volume sub-assemblies each having a snap-on low volume emitter having a separation pressure on the order of 25 p.s.i. or less;

fitting each low volume sub-assembly with means for filtering and controlling the flow rate and pressure of water between the interior of the riser and the emitter to a pressure less than said separation pressure; and installing one of the low volume sub-assemblies into the extremity of each pop-up unit by extending the filtering and flow controlling means axially through the riser.

17. The method recited in claim 16 further comprising the step of coding an external portion of the low volume sub-assembly with an indication of the flow rate of the sub-assembly.

18. A low volume pop-up irrigation assembly, comprising;

an elongated hollow housing having a first open end adapted for connection to a water supply and a second end;

an elongated pop-up riser having a hollow interior and extending through the housing, the riser having a first, open end communicating with the first end of the housing and a second end dimensioned to extend through the second end of the housing;

means for biasing the first end of the riser toward the first end of the housing, the biasing means selected to be overcome by a water pressure within the housing so that the water pressure pushes the second end of the riser out of the second end of the housing;

a low volume irrigation sub-assembly removably fitted into the second end of the riser, the low volume sub-assembly including a platform with upper and lower surfaces and dimensioned to extend across and removably connect with the second of the riser;

a snap-on emitter having a separation pressure on the order of about 25 p.s.i. or less removably attached with the upper surface of the platform, the emitter having a spray aperture communicating with the hollow interior of the riser; and a flow regulator mounted within the riser and adjacent to the lower surface of the platform, the flow regulator including means for restricting the pressure of water passing through the riser into the sub-assembly to a pressure less than said separation pressure.

* * * * *